US006774296B2

(12) United States Patent
Aesch

(10) Patent No.: US 6,774,296 B2
(45) Date of Patent: Aug. 10, 2004

(54) CLARINET WEATHER SHIELD COVER

(76) Inventor: Edward R. Aesch, 6142 W. Detroit St., Chandler, AZ (US) 85226

( * ) Notice: Subject to any disclaimer, the term of this patent is extended or adjusted under 35 U.S.C. 154(b) by 107 days.

(21) Appl. No.: 10/225,831

(22) Filed: Aug. 22, 2002

(65) Prior Publication Data

US 2004/0035742 A1 Feb. 26, 2004

(51) Int. Cl.[7] ..... A45C 11/00; G10D 7/00
(52) U.S. Cl. ..... 84/453; 2/66; 206/314
(58) Field of Search ..... 206/14, 314; 2/66, 2/162; 84/170, 382, 453, 380 R; 190/112; 224/576, 577, 910; 383/41, 72; 984/139

(56) References Cited

U.S. PATENT DOCUMENTS 2,160,229 A * 5/1939 Rupert ..... 206/314
4,893,357 A * 1/1990 Evans ..... 2/208
4,909,123 A * 3/1990 Butenschon, III ..... 84/453
5,139,187 A * 8/1992 Fowler ..... 224/576
5,875,890 A 3/1999 Bernardini
5,920,022 A * 7/1999 Ashwood, Jr. ..... 84/453
6,126,054 A * 10/2000 Riemer ..... 383/41
6,239,338 B1 * 5/2001 Robinson ..... 206/314

* cited by examiner

*Primary Examiner*—Luan K. Bui
(74) *Attorney, Agent, or Firm*—John D. Lister

(57) ABSTRACT

A clarinet weather shield cover for shielding the hands of a musician from weather conditions while playing a clarinet outdoors has a tubular envelope. The envelope has rear and forward openings that seal about the clarinet and a length greater than that portion of the clarinet containing the clarinet's finger holes and keys but less than the length of the clarinet so that both the mouth piece and the flared forward end of the clarinet extend beyond the tubular envelope. The lower portion of the envelope has hand openings through which the musician inserts his/her hands to play the clarinet. Preferably, the ends of the envelope are semi-rigid, the upper portion of the envelope is transparent to permit the passage of sunrays, and the bottom portion of the envelope is opaque to absorb the sunrays to warm the interior of the envelope.

14 Claims, 1 Drawing Sheet

FIG. 1
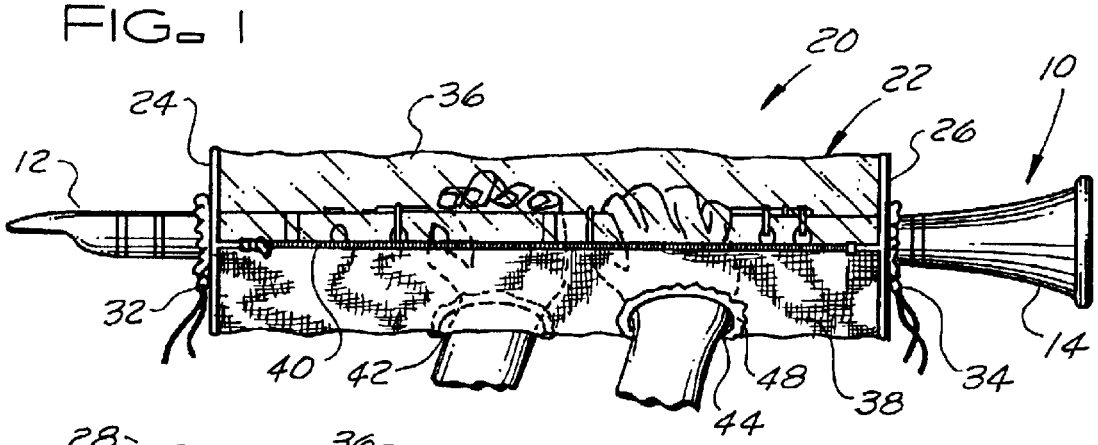
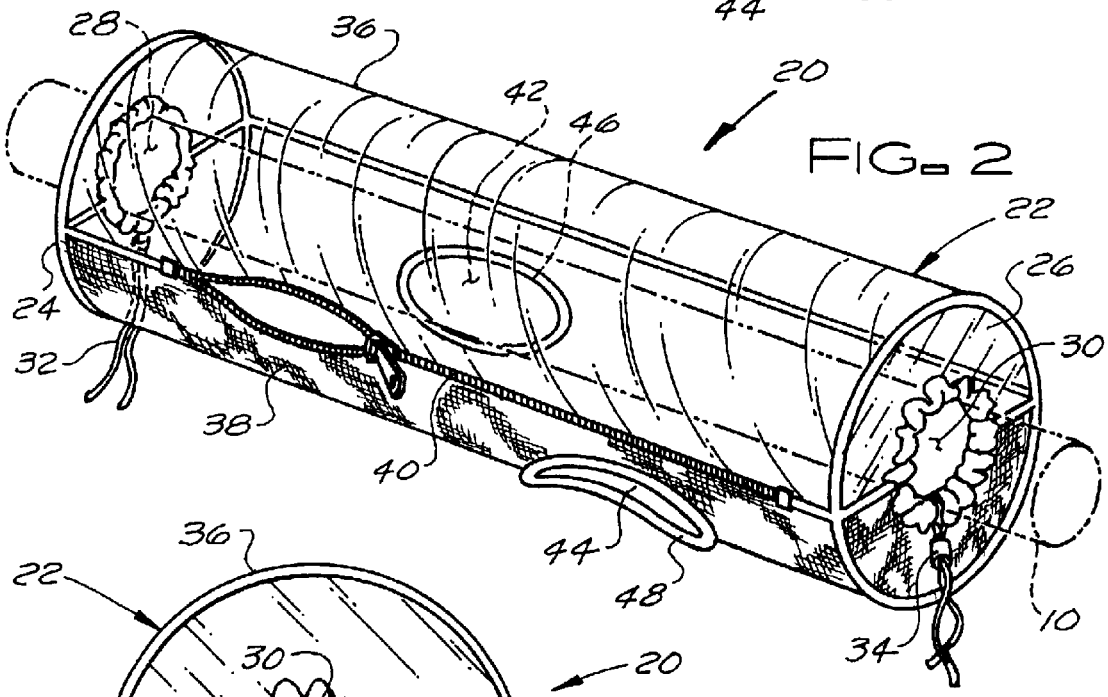
FIG. 2
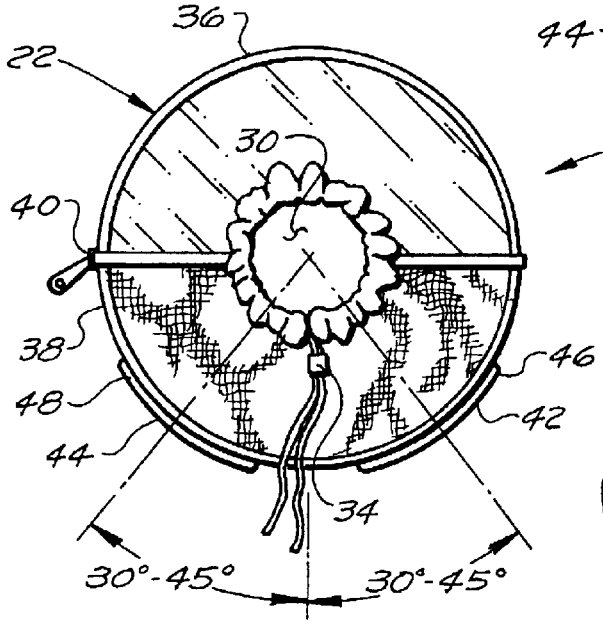
FIG. 3
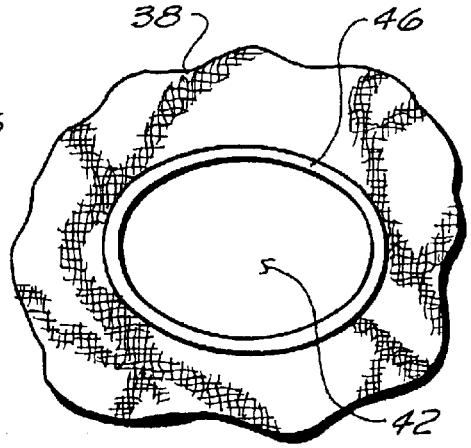
FIG. 4

CLARINET WEATHER SHIELD COVER

BACKGROUND OF THE INVENTION

The subject invention relates to a clarinet weather shield cover for shielding the hands of a musician from weather conditions while playing a clarinet outdoors.

When playing musical instruments outdoors, such as but not limited to the playing of musical instruments at outdoor athletic events (football), outdoor holiday events (new years day parades), and other outdoor events or ceremonies, frequently, the weather conditions are cold, rainy, sleety, snowy and/or otherwise adverse. Most musicians play musical instruments that permit them to wear gloves to protect and warm their hands while playing in such adverse weather conditions. However, due to the need for a clarinetist to finger the finger holes and manipulate the closely adjacent keys of a clarinet while playing a clarinet, a clarinetist can't wear protective gloves to warm his/her hands and keep them dry while effectively playing a clarinet. Thus, clarinetists have performed and continue to perform under adverse weather conditions without protecting their hands from adverse weather conditions such as cold, rain, sleet and/or snow. Playing a clarinet under such conditions is not only uncomfortable for the musician, but it can also affect his/her ability to play well.

SUMMARY OF THE INVENTION

The clarinet weather shield cover of the subject invention solves the problems outlined above by shielding the hands of a musician from weather conditions while the musician is playing a clarinet outdoors. The clarinet weather shield cover of the subject invention has a tubular envelope with rear and forward openings that seal about the clarinet. The length of the tubular envelope is greater than that portion of the clarinet containing the clarinet's finger holes and keys but less than the length of the clarinet so that both the mouthpiece and the flared forward end of the clarinet extend beyond the tubular envelope. The lower portion of the tubular envelope has hand openings through which the musician inserts his/her hands to play the clarinet. Preferably, the ends of the tubular envelope are semi-rigid circular walls that hold the central portion of the envelope away from the clarinet in a substantially cylindrical tubular configuration to prevent the envelope from interfering with the playing of the clarinet and to provide a space for the musician's hands that can be heated by the breath of the musician and sunrays. Preferably, the upper portion of the tubular envelope is translucent or transparent to permit the passage of sunrays into the envelope and the bottom portion of the tubular envelope is opaque to absorb the radiant energy of the sunrays entering the envelope through the upper portion of the envelope and warm the interior of the clarinet weather shield cover.

BRIEF DESCRIPTION OF THE DRAWINGS

FIG. 1 is a side view of the clarinet weather shield cover of the subject invention mounted on a clarinet.

FIG. 2 is a perspective view of the clarinet weather shield cover of FIG. 1 with the central portion of a clarinet represented in phantom line.

FIG. 3 is a front-end view of the clarinet weather shield cover of the subject invention.

FIG. 4 is an outside view of one of the hand openings in the clarinet weather shield cover.

DESCRIPTION OF THE PREFERRED EMBODIMENTS

As shown in FIG. 1 the clarinet weather shield cover 20 of the subject invention shields the hands of a musician from weather conditions while playing a clarinet 10 outdoors. The clarinet weather shield cover has a tubular envelope 22 with a rear end and a forward end. The tubular envelope 22 has a length greater than that portion of a clarinet 10 that contains the clarinet's finger holes and keys but less than the length of a clarinet 10 so that when the clarinet weather shield cover 20 is mounted on a clarinet a mouthpiece 12 at a rear end of the clarinet and a flared portion 14 of a forward end of the clarinet extend beyond the tubular envelope 22.

Preferably, the tubular envelope 22 is cylindrical and has waterproof circular end walls 24 and 26 at the rear end and the forward end of the tubular envelope to space the central portion of the tubular envelope from that portion of a clarinet mounted within the tubular envelope, prevent the tubular envelope from interfering with the playing of the clarinet, and provide a space within the tubular envelope for the musician's hands that can be heated by the breath of the musician and the radiant energy from sunrays. Preferably, the circular end walls 24 and 26 are rigid or semi rigid to better maintain the tubular envelope in a cylindrical configuration when mounted on a clarinet 10. The end wall 24 at the rear end of the envelope 22 has an opening 28 and the end wall 26 at the forward end of the envelope has an opening 30 through which a tubular body of a clarinet 10 passes when the clarinet weather shield cover 20 is mounted on a clarinet. The openings 28 and 30 in the end walls at the rear and forward ends of the tubular envelope 22 each close about or can be closed about the tubular body of a clarinet to seal the openings about the tubular body of a clarinet. By sealing the openings 28 and 30 of the tubular envelope 22 about the tubular body of a clarinet 10, the interior of the tubular envelope 22 is sealed against weather conditions and to retain heated air within the envelope so that a musician's hands are kept dry and warm. The openings 28 and 30 may have elastic hems or rims that automatically close the openings about the tubular body of a clarinet 10 when the clarinet weather shield cover 20 is mounted on a clarinet, draw strings 32 and 34 for drawing the openings closed about the tubular body of a clarinet 10 when the clarinet weather shield cover 20 in mounted on a clarinet, or other means for closing and sealing the openings 28 and 30 about the tubular body of a clarinet 10 when the clarinet weather shield cover 20 in mounted on a clarinet.

The tubular envelope 22 has an upper portion 36 extending from the rear end to the forward end of the tubular envelope. The upper portion 36 of the tubular envelope 22 permits the passage of light rays from the sun into the interior of the tubular envelope to warm the interior of the tubular envelope. Preferably, the upper portion 36 of the tubular envelope 22 forms the upper half or substantially the upper half of the tubular envelope and is made of a waterproof translucent or transparent material such as a polymeric film sheet that is semi rigid to help the envelope maintain a cylindrical shape when the clarinet weather shield cover 20 is mounted on a clarinet.

The tubular envelope 22 has a lower portion 38 extending from the rear end to the forward end of the tubular envelope. Preferably, the lower portion 38 of the tubular envelope 22 is opaque to absorb radiant energy from the sunrays passing through the upper potion of the envelope and heat the interior of the tubular envelope. Preferably, the lower portion 38 of the tubular envelope 22 forms the lower half or substantially the lower half of the tubular envelope and is made of a waterproof opaque material, such as but not limited to a nylon or polyester woven or nonwoven fabric, a polymeric film sheet, etc., that is semi rigid to help the tubular envelope maintain a cylindrical shape when the clarinet weather shield cover 20 is mounted on a clarinet.

A zipper 40 or other device for closing and opening the tubular envelope 22 of the clarinet weather shield cover 20 may be included in the tubular envelope for gaining access to the interior of the tubular envelope after the clarinet weather shield cover 20 is mounted on a clarinet. Preferably, the zipper 40 or other device enables the tubular envelope 22 to be opened and closed longitudinally for substantially the entire length of the tubular envelope and is located intermediate the upper and lower portions 36 and 38 of the tubular envelope 22 on one side of the tubular envelope.

The lower portion 38 of the tubular envelope 22 has a left hand opening 42 and a right hand opening 44 therein through which the hands of a musician are inserted to play a clarinet 10 on which the clarinet weather shield cover 20 is mounted. Preferably, as shown in FIG. 3, the left and right hand openings 42 and 44 each enter the tubular envelope at an angle between 30° and 45° to the vertical and, as shown in FIGS. 1 and 2, the right hand opening 44 is forward of the left hand opening 42. Preferably, the left and right hand openings 42 and 44 in the lower portion 38 of the tubular envelope 22 each close about the musician's wrists to seal the interior of the envelope against weather conditions and retain heated air within the tubular envelope. The openings 42 and 44 may have elastic hems or rims 46 and 48 that automatically close the openings 42 and 44 about the wrists of a musician or other means, preferably for automatically closing and sealing the openings 42 and 44 about the wrists of a musician.

The clarinet weather shield cover 20 and especially the bottom portion 38 of the tubular envelope 22 may be made with materials of various desired colors, such as but not limited to a school's, college's or university's colors. In addition, various logos or other indicia may be printed or imprinted on the upper or lower portions of the tubular envelope, such as but not limited to a school's, college's or university's name or mascot.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A clarinet weather shield cover for shielding hands of a musician from weather conditions while playing a clarinet outdoors, comprising:

a tubular envelope; the tubular envelope having a rear end and a forward end; the tubular envelope having a length greater than that portion of a clarinet containing a clarinet's finger holes and keys but less than a length of a clarinet so that when the clarinet weather shield cover is mounted on a clarinet a mouth piece at a rear end of the clarinet and a flared portion of a forward end of the clarinet extend beyond the tubular envelope;

the tubular envelope having a first opening at the rear end of the tubular envelope and a second opening at the forward end of the tubular envelope through which a tubular body of a clarinet passes when the clarinet weather shield cover is mounted on a clarinet; the first opening at the rear end of the tubular envelope and the second opening at the forward end of the tubular envelope each having means for closing the first and second openings of the tubular envelope about a tubular body of a clarinet to seal an interior of the tubular envelope against weather conditions and retain heated air within the tubular envelope;

the tubular envelope having an upper portion extending from the rear end to the forward end of the tubular envelope and a lower portion extending from the rear end to the forward end of the tubular envelope;

the lower portion of the tubular envelope having a left hand opening and a right hand opening therein through which hands of a musician are inserted to play a clarinet on which the clarinet weather shield cover is mounted; and the right hand opening being forward of the left hand opening; and the tubular envelope having semi-rigid end walls at the rear end and the forward end of the tubular envelope to space that portion of the tubular envelope extending between the semi-rigid end walls of the tubular envelope from that portion of a clarinet mounted within the tubular envelope.

2. The clarinet weather shield cover according to claim 1, wherein:

the left and right hand openings in the lower portion of the tubular envelope each have means for closing the left and right hand openings about wrists of a musician with hands within the tubular envelope to seal the interior of the envelope against weather conditions and retain heated air within the tubular envelope.

3. The clarinet weather shield cover according to claim 2, wherein:

the upper portion of the tubular envelope is translucent to permit sunrays to pass into the interior of the tubular envelope to warm the interior of the tubular envelope.

4. The clarinet weather shield cover according to claim 3, wherein:

the lower portion of the tubular envelope is opaque to absorb radiant energy of sunrays passing through the upper translucent portion of the tubular envelope.

5. The clarinet weather shield cover according to claim 2, wherein:

the upper portion of the tubular envelope is transparent to permit sunrays to pass into the interior of the tubular envelope to warm the interior of the tubular envelope.

6. The clarinet weather shield cover according to claim 5, wherein:

the lower portion of the tubular envelope is opaque to absorb radiant energy of sunrays passing through the upper transparent portion of the tubular envelope.

7. A clarinet weather shield cover for shielding hands of a musician from weather conditions while playing a clarinet outdoors, comprising:

a tubular envelope; the tubular envelope having a rear end and a forward end; the tubular envelope having length greater than that portion of a clarinet containing a clarinet's finger holes and keys but less than a length of a clarinet so that when the clarinet weather shield cover is mounted on a clarinet a mouth piece at a rear end of the clarinet and a flared portion of a forward end of the clarinet extend beyond the tubular envelope;

the tubular envelope having a first opening at the rear end of the tubular envelope and a second opening at the forward end of the tubular envelope through which a tubular body of a clarinet passes when the clarinet weather shield cover is mounted on a clarinet; the first opening at the rear end of the tubular envelope and the second opening at the forward of the tubular envelope each having means for closing the first and second openings of the tubular envelope about a tubular body of a clarinet to seal an interior of the tubular envelope against weather conditions and retain heated air within the tubular envelope;

the tubular envelope having an upper portion extending from the rear end to the forward end of the tubular envelope and a lower portion extending from the rear end to the forward end of the tubular envelope; the upper portion of the tubular envelope is being translucent to permit sunrays to pass into the interior of the tubular envelope to warm the interior of the tubular envelope; and the lower portion of the tubular envelope having a left hand opening and a right hand opening therein through which hands of a musician are inserted to play a clarinet on which the clarinet weather shield cover is mounted; and the right hand opening being forward of the left hand opening.

8. The clarinet weather shield cover according to claim 7, wherein:

the lower portion of the tubular envelope is opaque to absorb radiant energy of sunrays passing through the upper translucent portion of the tubular envelope.

9. A clarinet weather shield cover for shielding hands of a musician from weather conditions while playing a clarinet outdoors, comprising:

a tubular envelope; the tubular envelope having a rear end and a forward end; the tubular envelope having a length greater than that portion of a clarinet containing a clarinet's finger holes and keys but less than a length of a clarinet so that when the clarinet weather shield cover is mounted on a clarinet a mouth piece at a rear end of the clarinet and a flared portion of forward end of the clarinet extend beyond the tubular envelope;

the tubular envelope having a first opening at the rear end of the tubular envelope and a second opening at the forward end of the tubular envelope through which a tubular body of a clarinet passes when the clarinet weather shield cover is mounted on a clarinet; the first opening at the rear end of the tubular envelope and the second opening at the forward end of the tubular envelope each having means for closing the first and second openings of the tubular envelope about a tubular body of a clarinet to seal an interior of the tubular envelope against weather conditions and retain heated air within the tubular envelope;

the tubular envelope having an upper portion extending from the rear end to the forward end of the tubular envelope and a lower portion extending from the rear end to the forward end of the tubular envelope; the upper portion of the tubular envelope being transparent to permit sunrays to pass into the interior of the tubular envelope to warm the interior of the tubular envelope; and the lower portion of the tubular envelope having a left hand opening and a right hand opening therein through which hands of a musician are inserted to play a clarinet on which the clarinet weather shield cover is mounted; and the right hand opening being forward of the left hand opening.

10. The clarinet weather shield cover according to claim 9, wherein:

the lower portion of the tubular envelope is opaque to absorb radiant energy of sunrays passing through the upper transparent portion of the tubular envelope.

11. The clarinet weather shield cover according to claim 1, wherein:

the tubular envelope includes a longitudinally extending zipper that may be opened to gain access to the interior of the tubular envelope and closed to seal the tubular envelope against weather conditions and retain heated air within the envelope.

12. A clarinet weather shield cover for shielding hands of a musician from weather conditions while playing a clarinet outdoors, comprising:

a tubular envelope; the tubular envelope having a rear end and a forward end; the tubular envelope having a length greater than that portion of a clarinet containing a clarinet's finger holes and key but less than a length of a clarinet so that when the clarinet weather shield cover is mounted on a clarinet a mouth piece at a rear end of the clarinet and a flared portion of a forward end of the clarinet extend beyond the tubular envelope;

the tubular envelope having semi-rigid end walls at the rear end and the forward end of the tubular envelope to space that portion of the tubular envelope extending between the semi-rigid end walls of the tubular envelope from that portion of a clarinet mounted within the tubular envelope; the semi-rigid end wall at the rear end of the tubular envelope having a first opening and the semi-rigid end wall at the forward end of the tubular envelope having an opening through which a tubular body of a clarinet passes when the clarinet weather shield cover is mounted on a clarinet; the first opening in the semi-rigid end wall at th rear end of the tubular envelope and the second opening in the semi-rigid end wall at th forward end of the tubular envelope each having means for closing the first and second openings of the tubular envelope about a tubular body of a clarinet to seal an interior of the tubular envelope against weather conditions and retain heated air within the tubular envelope;

the tubular envelope having an upper portion extending from the rear end to the forward end of the tubular envelope; the upper portion of the tubular envelope permitting the passage of sunrays into the interior of the tubular envelope to warm the interior of the tubular envelope;

the tubular envelope having a lower portion extending from the rear end to the forward end of the tubular envelope; the lower portion of the tubular envelope being opaque to absorb radiant energy from sunrays passing through the upper potion of the tubular envelope; and the lower portion of the tubular envelope having a left hand opening and a right hand opening therein through which hands of a musician are inserted to play a clarinet on which the clarinet weather shield cover is mounted; the left and right hand openings each entering the tubular envelope at an angle between 30° and 45° to the vertical; and the right hand opening being forward of the left hand opening; and the left and right hand openings in the lower portion of the tubular envelope each have means for closing the left and right hand openings about wrists of a musician with hands within the tubular envelope to seal the interior of the tubular envelope against weather conditions and retain heat d air within the tubular envelope.

13. The clarinet weather shield cover according to claim 12, wherein:

the upper portion of the tubular envelope is translucent and forms an upper half of the tubular envelope.

14. The clarinet weather shield cover according to claim 12, wherein:

the upper portion of the tubular envelope is transparent and forms an upper half of the tubular envelope.

* * * * *